US008029086B2

(12) United States Patent
Niimi et al.

(10) Patent No.: US 8,029,086 B2
(45) Date of Patent: Oct. 4, 2011

(54) PRINTING DEVICE, CONTROL METHOD THEREOF AND COMPUTER-READABLE RECORDING MEDIUM

(75) Inventors: Akiko Niimi, Kasugai (JP); Shumei Mori, Ichinomiya (JP); Toshiaki Mizutani, Kasugai (JP); Toshinobu Ozawa, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 450 days.

(21) Appl. No.: 12/289,199

(22) Filed: Oct. 22, 2008

(65) Prior Publication Data

US 2009/0102869 A1 Apr. 23, 2009

(30) Foreign Application Priority Data

Oct. 23, 2007 (JP) ..... 2007-275420

(51) Int. Cl.
*B41J 29/393* (2006.01)
*B41J 23/00* (2006.01)

(52) U.S. Cl. ..... 347/19; 347/37

(58) Field of Classification Search ..... 347/5, 37, 347/40, 104, 2, 19; 400/188
See application file for complete search history.

(56) References Cited

U.S. PATENT DOCUMENTS

| | | | | |
|---|---|---|---|---|
| 5,854,642 | A | 12/1998 | Takahashi et al. | |
| 6,267,518 | B1 * | 7/2001 | Abe | 400/188 |
| 6,712,444 | B2 * | 3/2004 | Abe et al. | 347/19 |
| 2003/0137550 | A1 | 7/2003 | Baiges | |
| 2004/0179047 | A1 | 9/2004 | Niimi | |
| 2005/0179708 | A1 | 8/2005 | Ben-Zur | |

FOREIGN PATENT DOCUMENTS

| | | | |
|---|---|---|---|
| EP | 0 835 761 | A2 | 4/1998 |
| JP | A-2004-268506 | | 9/2004 |
| WO | WO 2005/076730 | A2 | 8/2005 |

* cited by examiner

*Primary Examiner* — An Do
(74) *Attorney, Agent, or Firm* — Oliff & Berridge, PLC

(57) ABSTRACT

A printing device includes first and second print heads, first and second print head control units, a first print head feeding unit moving the first print head in a main scanning direction, a second print head feeding unit moving the second print head in the main scanning direction, a first medium feeding unit moving a first medium holding unit in an auxiliary scanning direction orthogonal to the main scanning direction, a second medium feeding unit moving a second medium holding unit in the auxiliary scanning direction in parallel with the movement of the first medium feeding unit, a first printing unit control unit (controlling the first print head control unit, the first print head feeding unit and the first medium feeding unit), and a second printing unit control unit (controlling the second print head control unit, the second print head feeding unit and the second medium feeding unit).

15 Claims, 9 Drawing Sheets

PRINTING DEVICE, CONTROL METHOD THEREOF AND COMPUTER-READABLE RECORDING MEDIUM

CROSS-REFERENCE TO RELATED APPLICATION

This application claims priority under 35 U.S.C. §119 from Japanese Patent Application No. 2007-275420 filed on Oct. 23, 2007. The entire subject matter of the application is incorporated herein by reference.

BACKGROUND OF THE INVENTION

The present invention relates to a printing device, and in particular, to a printing device equipped with two or more medium holding units for holding print media to be printed on. The present invention relates also to a control method, a computer program and a computer-readable recording medium for the printing device.

Fabric printing devices, equipped with one carriage (for feeding a print head for discharging ink onto fabric held on a planar platen), one operation panel and one color ink set, are well known (see Japanese Patent Provisional Publication No. 2004-268506, for example). The fabric printing device carries out the printing of print data on fabric by moving the carriage and the platen in a main scanning direction and in an auxiliary scanning direction, respectively.

Inkjet printers generally require longer printing time compared to automatic screen printers. In order to speed up the printing operation, there has been proposed a printing device having an enlarged main body, two or more platens of the same size horizontally arranged on the same plane, and one print head successively executing printing on print media held on the platens (see FIG. 7C and FIG. 7B of United States Patent Application Publication No. US2005/0179708 A1 (hereinafter referred to as '708 publication), for example).

SUMMARY OF THE INVENTION

The printing device described in the patent document '708 publication is capable of achieving improved print efficiency compared to printing devices having only one platen. However, when an error due to or related to one of the platens (holding the print media) or the carriage (feeding the print head) has occurred, the print operations for the other platens are also necessitated to be stopped.

The present invention, which has been made in consideration of the above problem, is advantageous in that a printing device equipped with two or more medium holding units, capable of not only improving the print job efficiency but also continuing or executing the print operation for at least one medium holding unit even when abnormality (e.g. failure) has occurred to a part of the printing device related to one of the medium holding units, can be provided. The present invention also provides a control method, a computer program, and a computer-readable recording medium for the printing device.

In accordance with an aspect of the present invention, there is provided a printing device comprising a first print head which discharges ink onto a print medium according to print data, a second print head which discharges ink onto a print medium according to print data, a first print head control unit which controls the discharge of ink from the first print head, a second print head control unit which controls the discharge of ink from the second print head, a first print head feeding unit which moves the first print head in a main scanning direction relative to the print medium, a second print head feeding unit which moves the second print head in the main scanning direction relative to the print medium, a first medium holding unit having a holding surface for holding one print medium, a second medium holding unit having a holding surface for holding one print medium, a first medium feeding unit capable of moving the first medium holding unit to and fro in an auxiliary scanning direction orthogonal to the main scanning direction, a second medium feeding unit capable of moving the second medium holding unit to and fro in the auxiliary scanning direction in parallel with the movement of the first medium feeding unit, a first ink cartridge which supplies the ink to the first print head, a second ink cartridge which supplies the ink to the second print head, a first printing unit control unit which controls the first print head control unit, the first print head feeding unit and the first medium feeding unit, and a second printing unit control unit which controls the second print head control unit, the second print head feeding unit and the second medium feeding unit.

In the printing device configured as above, the first print head control unit, the first print head feeding unit and the first medium feeding unit are controlled by the first printing unit control unit, while the second print head control unit, the second print head feeding unit and the second medium feeding unit are controlled by the second printing unit control unit. Therefore, the first and second printing unit control units are capable of executing the print control (of first and second printing units, respectively) independently of each other. Thus, even when an error has occurred to one printing unit, the other printing unit can continue or execute its print operation, by which deterioration of print efficiency due to stoppage of both printing units can be prevented. Incidentally, the number of printing units is not restricted to two; the printing device may include three or more printing units (three or more printing unit control units).

In accordance with another aspect of the present invention, there is provided a control method of a printing device which is equipped with a first print head which discharges ink onto a print medium according to print data, a second print head which discharges ink onto a print medium according to print data, a first print head control unit which controls the discharge of ink from the first print head, a second print head control unit which controls the discharge of ink from the second print head, a first print head feeding unit which moves the first print head in a main scanning direction relative to the print medium, a second print head feeding unit which moves the second print head in the main scanning direction relative to the print medium, a first medium holding unit having a holding surface for holding one print medium, a second medium holding unit having a holding surface for holding one print medium, a first medium feeding unit capable of moving the first medium holding unit to and fro in an auxiliary scanning direction orthogonal to the main scanning direction, a second medium feeding unit capable of moving the second medium holding unit to and fro in the auxiliary scanning direction in parallel with the movement of the first medium feeding unit, a first ink cartridge which supplies the ink to the first print head, a second ink cartridge which supplies the ink to the second print head, a first printing unit control unit which controls the first print head control unit, the first print head feeding unit and the first medium feeding unit, and a second printing unit control unit which controls the second print head control unit, the second print head feeding unit and the second medium feeding unit. The control method comprises a first notification step of making a first notification unit give at least one selected from notification of operation completion, previous notification of operation completion and notification of occurrence of error during the control of the first print head control unit, the first print head feeding unit and the first medium feeding unit by the first printing unit control unit, and a second notification step of making a second notification unit give at least one selected from notification of operation completion, previous notification of operation completion and notification of occurrence of error during the control of the second print head control unit, the second print head feeding unit and the second medium feeding unit by the second printing unit control unit.

In the printing device controlled by the above control method, the first and second printing unit control units are capable of executing the print control (of first and second printing units, respectively) independently of each other, and thus each printing unit can continue or execute its print operation even when an error has occurred to the other printing unit, by which deterioration of print efficiency due to stoppage of both printing units can be prevented. With the above control method comprising the first and second notification steps, the operator is allowed to correctly recognize the status of the operation of each printing unit and thereby advance to the next work smoothly.

In accordance with another aspect of the present invention, there is provided a computer-readable recording medium storing computer-readable instructions that cause a computer to execute any one of the above control methods.

With the above computer-readable recording medium, effects similar to those of the above control methods can be achieved by making a computer operate according to the computer-readable instructions obtained (loaded, installed, etc.) from the recording medium.

Other objects, features and advantages of the present invention will become more apparent from the consideration of the following detailed description taken in conjunction with the accompanying drawings.

BRIEF DESCRIPTION OF THE ACCOMPANYING DRAWINGS

DETAILED DESCRIPTION OF THE EMBODIMENTS

Figure 1:
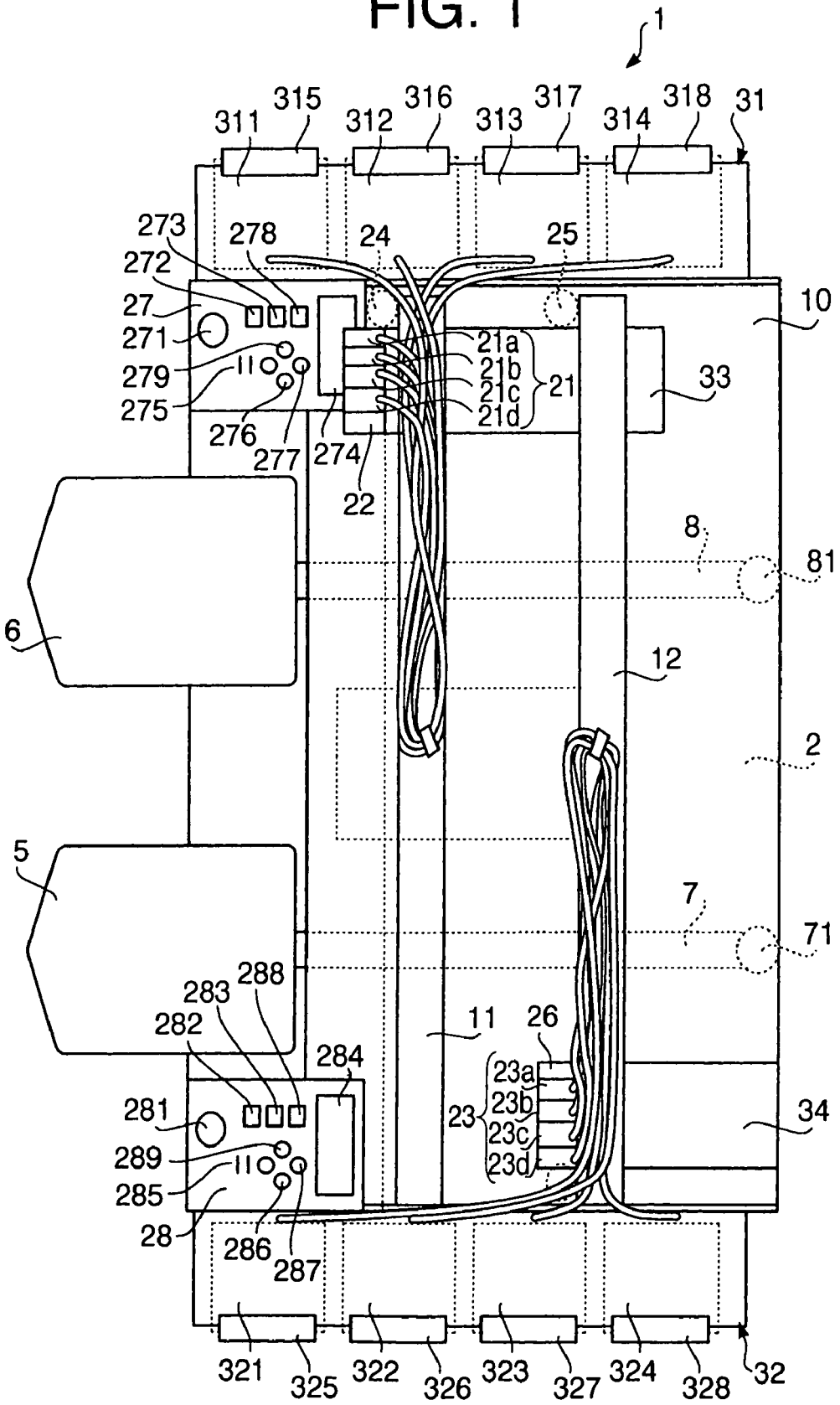
FIG. 1 is a plan view of an inkjet printer (printing device) in accordance with a first embodiment of the present invention.

Referring now to the drawings, a description will be given in detail of preferred embodiments in accordance with the present invention.

Embodiment 1

Figure 2:
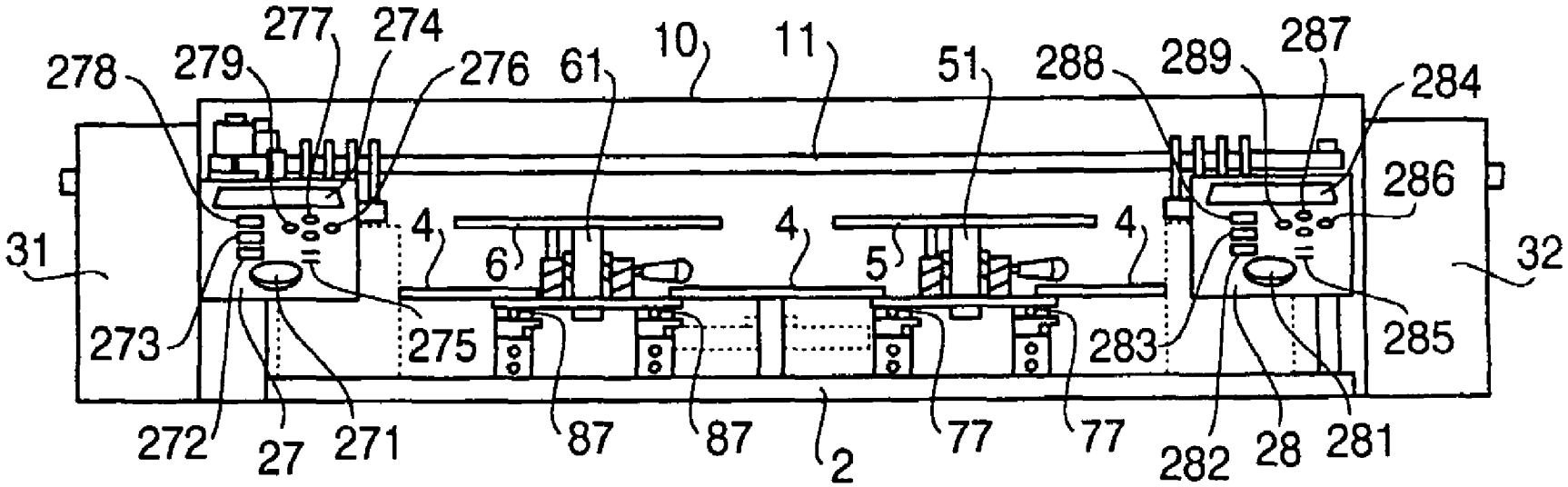
FIG. 2 is a front view of the inkjet printer.
Figure 3:
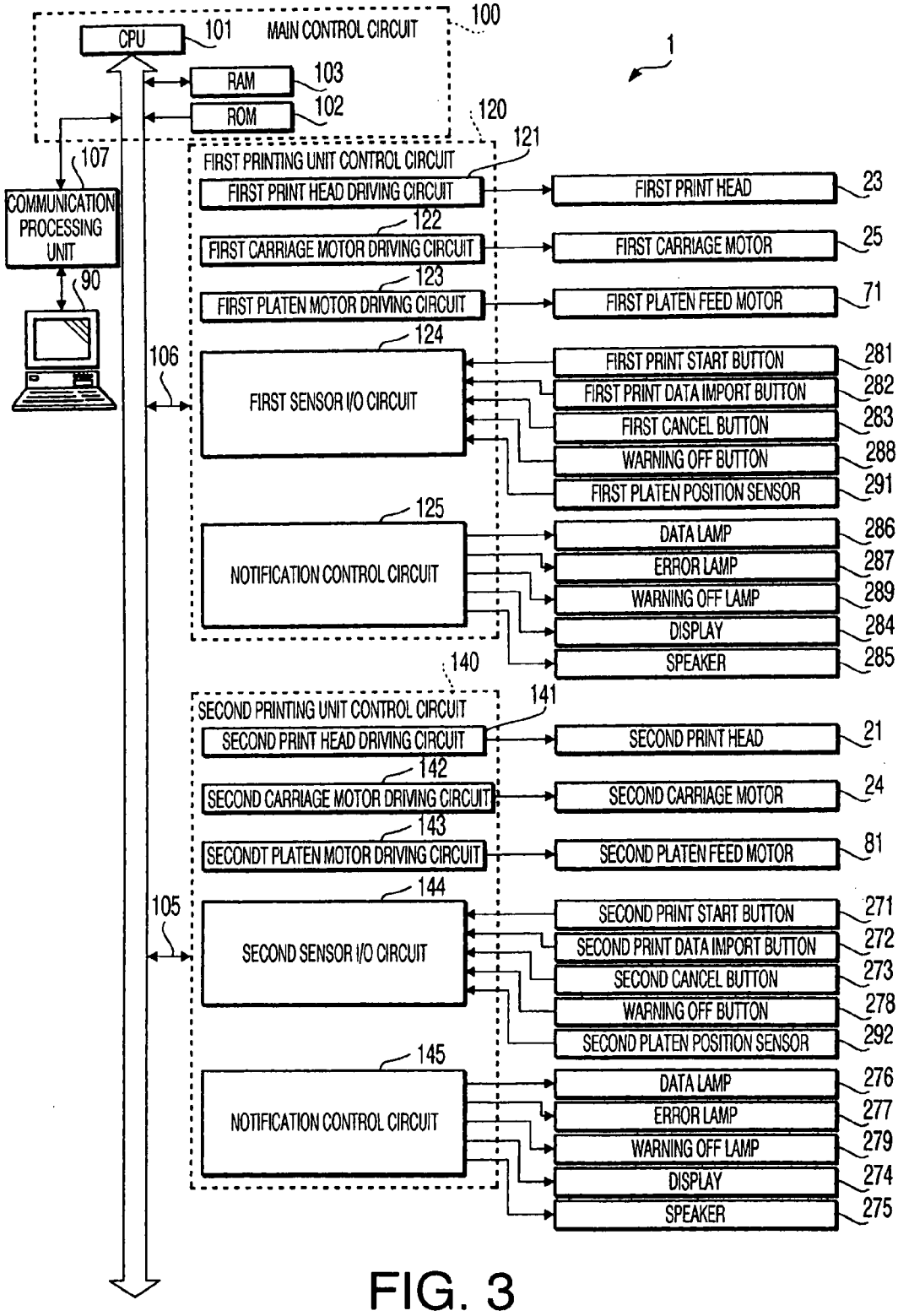
FIG. 3 is a block diagram showing the electrical configuration of the inkjet printer.
Figure 4:
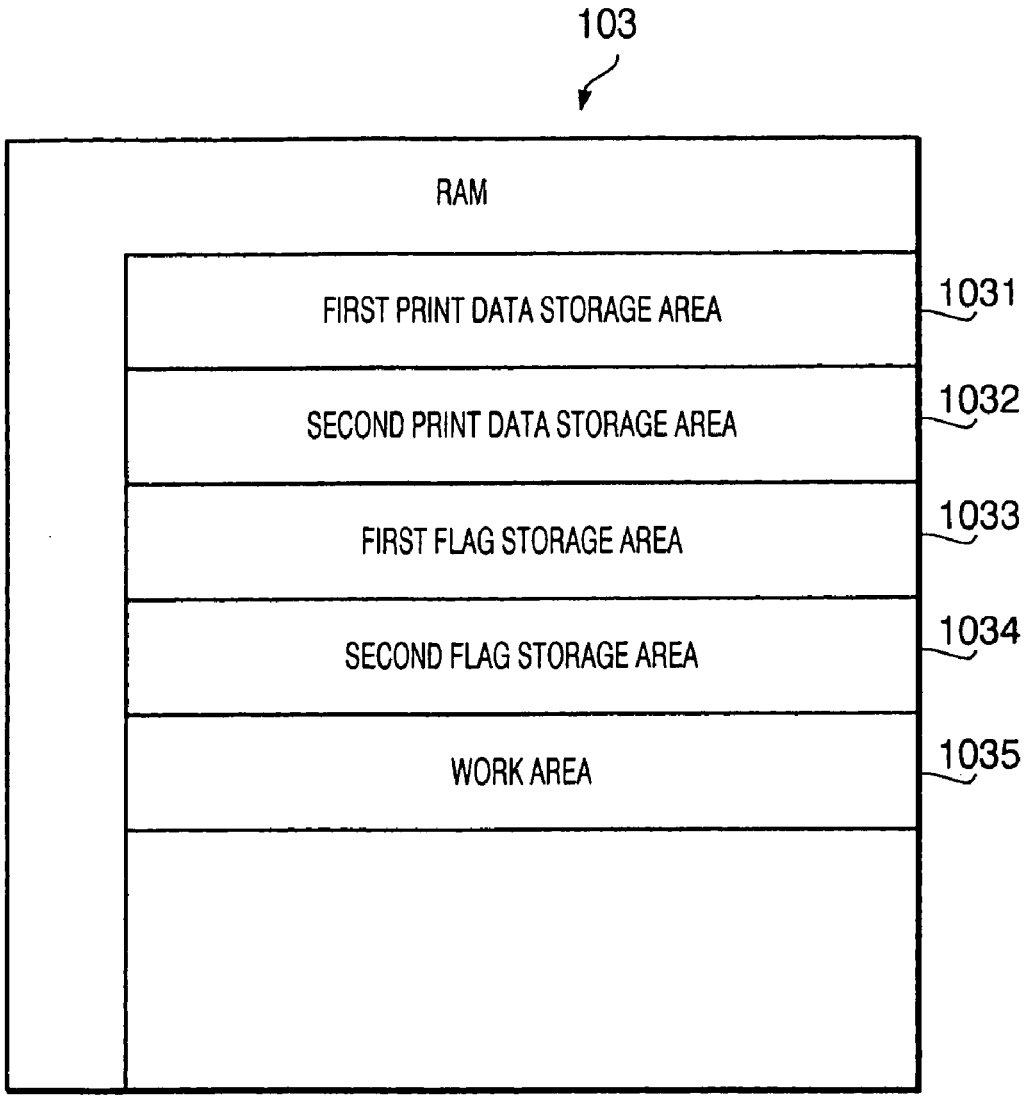
FIG. 4 is a conceptual diagram of storage areas of a RAM of the inkjet printer.

FIG. 1 is a plan view of an inkjet printer 1 (printing device) in accordance with a first embodiment of the present invention. FIG. 2 is a front view of the inkjet printer 1. FIG. 3 is a block diagram showing the electrical configuration of the inkjet printer 1. FIG. 4 is a conceptual diagram of storage areas of a RAM 103 of the inkjet printer 1.

The inkjet printer 1 of this embodiment is a printer employing the well-known inkjet printing technology. The inkjet printer 1 executes printing on print media by supplying ink to two print heads (first print head 23, second print head 21). The first print head 23 is provided with four inkjet heads 23*a*, 23*b*, 23*c* and 23*d*, each having a nozzle face, for discharging four color inks (i.e., cyan, magenta, yellow and black inks). Similarly, the second print head 21 is provided with four inkjet heads 21*a*, 21*b*, 21*c* and 21*d*, each having a nozzle face, for discharging four color inks (i.e., cyan, magenta, yellow and black inks). The first and second print heads 23 and 21 are mounted on first and second carriages 26 and 22, respectively. The inkjet printer 1 of this embodiment is designed to handle fabrics (e.g. T-shirts) as the print media. Thus, the inkjet printer 1 executes printing on fabrics (T-shirts, etc.) by discharging ink from the first and second print heads 23 and 21 according to image information (print data) inputted thereto. As shown in FIGS. 1 and 2, the inkjet printer 1 has a base 2 (like a flat plate) as its bottom and a body cover 10 covering the whole of the printer body.

Incidentally, the left-hand side of FIG. 1 corresponds to the front of the inkjet printer 1. In this explanation, the upper part of FIG. 1 and the left-hand side of FIG. 2 are assumed to correspond to the "left-hand side" of the inkjet printer 1. Thus, the lower part of FIG. 1 and the right-hand side of FIG. 2 correspond to the "right-hand side" of the inkjet printer 1. The horizontal direction of the inkjet printer 1 (vertical direction in FIG. 1) corresponds to a "main scanning direction" in which the first print head 23 (first carriage 26) and the second print head 21 (second carriage 22) move to and fro.

A printing mechanism inside the body cover 10 is configured as a mechanism employing the well-known inkjet printing technology. In a rear part of the inkjet printer 1 (right-hand side in FIG. 1) inside the body cover 10, a guide rail 12 is placed in order to guide the movement of the first carriage 26 (on which the first print head 23 is mounted) in the horizontal direction of the inkjet printer 1 (i.e. main scanning direction, vertical direction in FIG. 1). A first carriage motor 25 is placed nearby the left-hand end (upper end in FIG. 1) of the guide rail 12, a pulley (unshown) is placed nearby the right-hand end (lower end in FIG. 1) of the guide rail 12, and a carriage belt (unshown) is stretched between the first carriage motor 25 and the pulley. The first carriage 26, whose back is fixed to the carriage belt, is moved to and fro along the guide rail 12 by the driving force of the first carriage motor 25. Incidentally, a maintenance unit (including a capping mechanism, a wipe mechanism and a purge mechanism) 34 for the maintenance of the first print head 23 is placed at the right-hand end of the guide rail 12.

Meanwhile, in front of the guide rail 12 (to the left of the guide rail 12 in FIG. 1), another guide rail 11 is placed in order to guide the movement of the second carriage 22 (on which the second print head 21 is mounted) in the horizontal direction of the inkjet printer 1 (i.e. main scanning direction, vertical direction in FIG. 1). A second carriage motor 24 is placed nearby the left-hand end (upper end in FIG. 1) of the guide rail 11, a pulley (unshown) is placed nearby the right-hand end (lower end in FIG. 1) of the guide rail 11, and a carriage belt (unshown) is stretched between the second carriage motor 24 and the pulley. The second carriage 22, whose back is fixed to the carriage belt, is moved to and fro along the guide rail 11 by the driving force of the second carriage motor 24. A maintenance unit (including a capping mechanism, a wipe mechanism and a purge mechanism) 33 for the maintenance of the second print head 21 is placed at the left-hand end of the guide rail 11.

Next, a first platen 5 and a second platen 6 (which are employed in the inkjet printer 1 of this embodiment for holding the fabrics as the print media) will be explained. Differently from ordinary inkjet printers, the inkjet printer 1 is equipped with a pair of platens (first platen 5, second platen 6) of the same shape. The first and second platens 5 and 6 are movable in an "auxiliary scanning direction" (front-to-back direction of the inkjet printer 1, horizontal direction in FIG. 1) which is orthogonal to the main scanning direction of the first and second print heads 23 and 21.

Therefore, the base 2 is provided with a first feeding mechanism 7 (for guiding the movement of the first platen 5 (holding the print medium) in the horizontal direction in FIG. 1) and a second feeding mechanism 8 (for guiding the movement of the second platen 6 in the horizontal direction in FIG. 1) which are placed in parallel with each other. As shown in FIG. 2, the first feeding mechanism 7 includes a pair of guide rails 77, a first platen feed motor 71 (implemented by a stepping motor) placed at the rear end (right-hand end in FIG. 1) of the guide rails 77, etc. as shown in FIG. 1. By the driving force of the first platen feed motor 71, the first platen 5 is moved to and fro in the auxiliary scanning direction along the guide rails 77 of the first feeding mechanism 7. Incidentally, the first platen feed motor 71 is placed in the back of the body cover 10 (right-hand end in FIG. 1). Similarly to the first feeding mechanism 7, the second feeding mechanism 8 includes a pair of guide rails 87, a second platen feed motor 81 (stepping motor) placed at the rear end (right-hand end in FIG. 1) of the guide rails 87, etc. as shown in FIG. 1. By the driving force of the second platen feed motor 81, the second platen 6 is moved to and fro in the auxiliary scanning direction along the guide rails 87 of the second feeding mechanism 8. The second platen feed motor 81 is placed in the back of the body cover 10 (right-hand end in FIG. 1).

Each of the first and second platens 5 and 6 is formed in a pentagonal shape (like a home plate) in the plan view. Specifically, the pentagonal shape of each platen is like a substantially rectangular plate from which the center of its short side facing the operator (user) is protruding toward the operator. The top surface of each platen 5, 6 is shaped properly so that the print medium (fabric such as a T-shirt) can be horizontally placed and held thereon.

Beneath the first and second platens 5 and 6, three trays 4 (whose bases are substantially parallel to the tops of the first and second platens 5 and 6) are placed. The trays 4 are employed for receiving a part of the fabric (e.g. a sleeve of a T-shirt) to prevent the part from dropping onto the base 2 when the user puts the fabric (e.g. T-shirt) on the first platen 5 or the second platen 6.

As shown in FIG. 2, the right-hand end part of the body cover 10 is provided with a first ink cartridge storing unit 32. The first ink cartridge storing unit 32 stores ink cartridges (first ink cartridges) 321, 322, 323 and 324 of inks of the four colors CMYK (Cyan, Magenta, Yellow, blacK) for the first print head 23 (i.e., the inkjet heads 23*a*, 23*b*, 23*c* and 23*d*). The first ink cartridge storing unit 32 is equipped with fixing mechanisms 325, 326, 327 and 328 for fixing the ink cartridges 321, 322, 323 and 324, respectively.

Meanwhile, the left-hand end part of the body cover 10 is provided with a second ink cartridge storing unit 31. The second ink cartridge storing unit 31 stores ink cartridges (second ink cartridges) 311, 312, 313 and 314 of the inks of the four colors CMYK for the second print head 21 (i.e., the inkjet heads 21*a*, 21*b*, 21*c* and 21*d*). The second ink cartridge storing unit 31 is equipped with fixing mechanisms 315, 316, 317 and 318 for fixing the ink cartridges 311, 312, 313 and 314, respectively. The CMYK ink cartridges stored in the first and second ink cartridge storing units 32 and 31 are connected to the first and second print heads 23 and 21, respectively, via ink supply tubes, by which the inks of the four colors CMYK are supplied to the first and second print heads 23 and 21.

As shown in FIGS. 1 and 2, a first operation panel 28 (for letting the user operate the first platen 5, the first print head 23 and the first carriage 26 of the inkjet printer 1 (these components will hereinafter be collectively referred to as a "first printing unit")) is placed in the right-hand end part of the front of the inkjet printer 1. The first operation panel 28 includes a first print start button 281 to be pressed for issuing a print instruction, a display 284 (implemented by an LCD (Liquid Crystal Display)) for displaying a variety of information, a first cancel button 283 to be pressed for canceling the print instruction, a first print data import button 282 to be pressed for ordering import of print data, a data lamp 286 for indicating data reception, an error lamp 287 for indicating the occurrence of an error, a speaker 285 for making a warning sound (e.g. beep), etc.

Meanwhile, as shown in FIGS. 1 and 2, a second operation panel 27 (for letting the user operate the second platen 6, the second print head 21 and the second carriage 22 of the inkjet printer 1 (these components will hereinafter be collectively referred to as a "second printing unit")) is placed in the left-hand end part of the front of the inkjet printer 1. The second operation panel 27 includes a second print start button 271 to be pressed for issuing a print instruction, a display 274 (LCD) for displaying a variety of information, a second cancel button 273 to be pressed for canceling the print instruction, a second print data import button 272 to be pressed for ordering the import of print data, a data lamp 276 for indicating data reception, an error lamp 277 for indicating the occurrence of an error, a speaker 275 for making a warning sound (e.g. beep), etc. Thus, the speaker 285 (of the first operation panel 28) and the speaker 275 (of the second operation panel 27) are placed at both ends of the front of the inkjet printer 1 in regard to the main scanning direction of the first and second print heads 23 and 21.

Next, the electrical configuration of the inkjet printer 1 will be described below referring to FIG. 3. As shown in FIG. 3, the inkjet printer 1 includes a main control circuit 100 for the overall control of the inkjet printer 1, a first printing unit control circuit 120 for controlling the first printing unit, and a second printing unit control circuit 140 for controlling the second printing unit.

The main control circuit 100 includes a CPU (Central Processing Unit) 101 as a computer. A ROM (Read Only Memory) 102 storing various control programs (to be executed by the CPU 101), etc. and a RAM (Random Access Memory) 103 for temporarily storing data are connected to the CPU 101 via a bus 104. The first printing unit control circuit 120 and the second printing unit control circuit 140 are also connected to the CPU 101 via the bus 104. Further, a personal computer 90 capable of generating and outputting print data is connected to the CPU 101 via a communication processing unit 107 which is connected to the bus 104.

The first printing unit control circuit 120 includes a first print head driving circuit 121 for the driving control of each piezoelectric actuator of each channel of the first print head 23, a first carriage motor driving circuit 122 for the driving control of the first carriage motor 25, and a first platen motor driving circuit 123 for the driving control of the first platen feed motor 71. Also included in the first printing unit control circuit 120 are a first sensor input/output circuit 124 and a notification control circuit 125. The first sensor input/output circuit 124 receives inputs from the first print start button 281, the first print data import button 282, the first cancel button 283, a warning OFF button 288 (to be pressed for prohibiting print operation completion preannouncement) and a first platen position sensor 291 (detecting the position of the first platen 5). The notification control circuit 125 controls the data lamp 286, the error lamp 287, a warning OFF lamp 289 (indicating the pressing of the warning OFF button 288), the display 284 and the speaker 285.

The second printing unit control circuit 140 includes a second print head driving circuit 141 for the driving control of each piezoelectric actuator of each channel of the second print head 21, a second carriage motor driving circuit 142 for the driving control of the second carriage motor 24, and a second platen motor driving circuit 143 for the driving control of the second platen feed motor 81. Also included in the second printing unit control circuit 140 are a second sensor input/output circuit 144 and a notification control circuit 145. The second sensor input/output circuit 144 receives inputs from the second print start button 271, the second print data import button 272, the second cancel button 273, a warning OFF button 278 (to be pressed for prohibiting the print operation completion preannouncement) and a second platen position sensor 292 (detecting the position of the second platen 6). The notification control circuit 145 controls the data lamp 276, the error lamp 277, a warning OFF lamp 279 (indicating the pressing of the warning OFF button 278), the display 274 and the speaker 275.

Next, the storage areas of the RAM 103 of the main control circuit 100 will be explained below referring to FIG. 4. As shown in FIG. 4, the storage areas reserved in the RAM 103 include a first print data storage area 1031 for storing print data for the first print head 23, a second print data storage area 1032 for storing print data for the second print head 21, a first flag storage area 1033 for storing a print operation completion preannouncement prohibition flag for the first print head 23, a second flag storage area 1034 for storing the print operation completion preannouncement prohibition flag for the second print head 21, and a work area 1035 for temporarily storing various data during the operation of the CPU 101.

Figure 5:
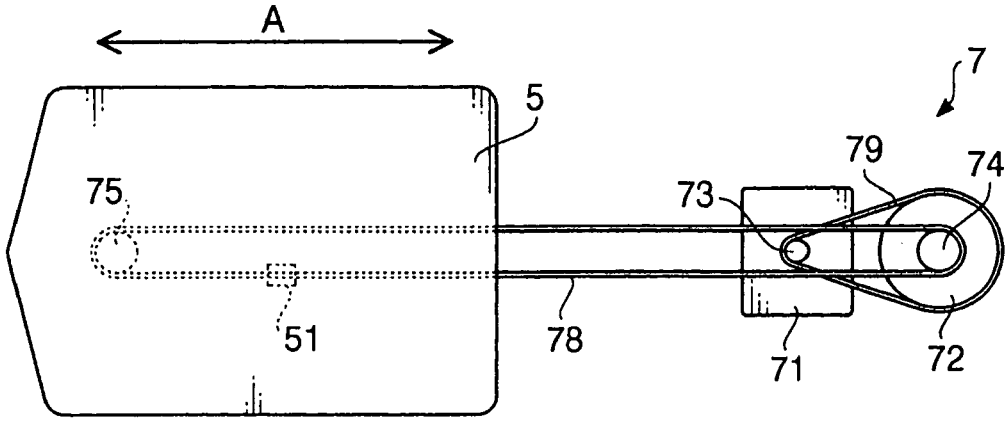
FIG. 5 is a schematic plan view of a first feeding mechanism for feeding a first platen of the inkjet printer.
Figure 6:
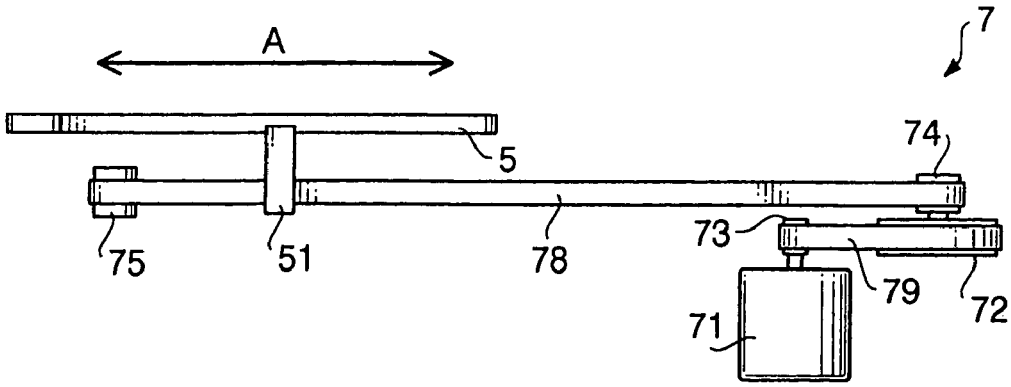
FIG. 6 is a schematic left side view of the first feeding mechanism.

Next, the first feeding mechanism 7 for feeding the first platen 5 will be explained below referring to FIGS. 5 and 6. FIG. 5 is a schematic plan view of the first feeding mechanism 7. FIG. 6 is a schematic left side view of the first feeding mechanism 7. Incidentally, the left-hand side in FIGS. 5 and 6 corresponds to the front part of the inkjet printer 1 (the right-hand side corresponds to the rear part).

As shown in FIGS. 5 and 6, the first feeding mechanism 7 includes a large pulley 72, a motor pulley 73 which is rotated by the first platen feed motor 71, and a motor belt 79 which is stretched between the motor pulley 73 and the large pulley 72. The large pulley 72 is driven and rotated by driving force which is transmitted from the first platen feed motor 71 via the motor pulley 73 and the motor belt 79. A first belt pulley 74, sharing a common rotating shaft with the large pulley 72, rotates in sync with the large pulley 72. The first platen feed motor 71, the motor pulley 73, the motor pulley 73 and the first belt pulley 74 are all placed under the plane of movement of the first platen 5 inside the body cover 10 of the inkjet printer 1. A second belt pulley 75 (paired with the first belt pulley 74) is placed in the front part of the inkjet printer 1 (left-hand side in FIGS. 5 and 6), and a timing belt 78 is stretched between the first belt pulley 74 and the second belt pulley 75. The first and second belt pulleys 74 and 75 are of the same diameter.

The first and second belt pulleys 74 and 75 are placed so that a line connecting their centers is orthogonal to the main scanning direction of the first print head 23 (i.e. the direction of the guide rail 12), in order to make the timing belt 78 be stretched in the direction orthogonal to the main scanning direction. The first platen 5, which is fixed to the timing belt 78 via a platen fixation part 51, moves in the front-to-back direction of the inkjet printer 1 (i.e. the direction of the arrow A in FIGS. 5 and 6) according to the rotation of the timing belt 78. As above, the rotation of the first platen feed motor 71 is converted into the horizontal movement of the first platen 5 by the motor pulley 73, the motor belt 79, the large pulley 72, the first belt pulley 74, the timing belt 78 and the second belt pulley 75.

Here, the first platen feed motor 71 will be explained in more detail. The first platen feed motor 71 is a 1-2 phase excitation stepping motor of a well-known type. In the first platen feed motor 71, a stator as an electromagnet is placed to surround a rotor. By the excitation of the stator, the rotor is attracted to the stator (electromagnet) and thereby rotates step by step. Specifically, the stator includes four types of segments corresponding to four excitation phases: A-phase, reverse A-phase, B-phase and reverse B-phase. The segments are arranged in the order of A-phase, B-phase, reverse A-phase, reverse B-phase, A-phase, B-phase, . . . in the clockwise direction. The stator segments are successively and selectively excited in a proper order like A-phase segments only, A-phase segments and B-phase segments, B-phase segments only, B-phase segments and reverse A-phase segments, reverse A-phase segments only, reverse A-phase segments and reverse B-phase segments, reverse B-phase segments only, reverse B-phase segments and A-phase segments, A-phase segments only, . . . The S-poles of the rotor are attracted to N-poles formed by (induced in) the excited stator segments, while the N-poles of the rotor are repelled by the N-poles of the excited stator segments, by which the rotor of the stepping motor rotates step by step.

In short, the rotor of the first platen feed motor 71 can be rotated by the successive and selective excitation of the stator segments, by which the first platen 5 can be moved horizontally in the front-to-back direction of the inkjet printer 1. The angle of rotation of the rotor per one excitation is determined by the number of pole pairs (each made up of an N-pole and an S-pole) included in the rotor, and thus the moving distance of the first platen 5 can be controlled by the number of rotational steps (i.e. the number of excitations) of the first platen feed motor 71. Incidentally, the second feeding mechanism 8 for feeding the second platen 6 is configured similarly to the first feeding mechanism 7, and thus repeated explanation thereof is omitted.

Figure 7:
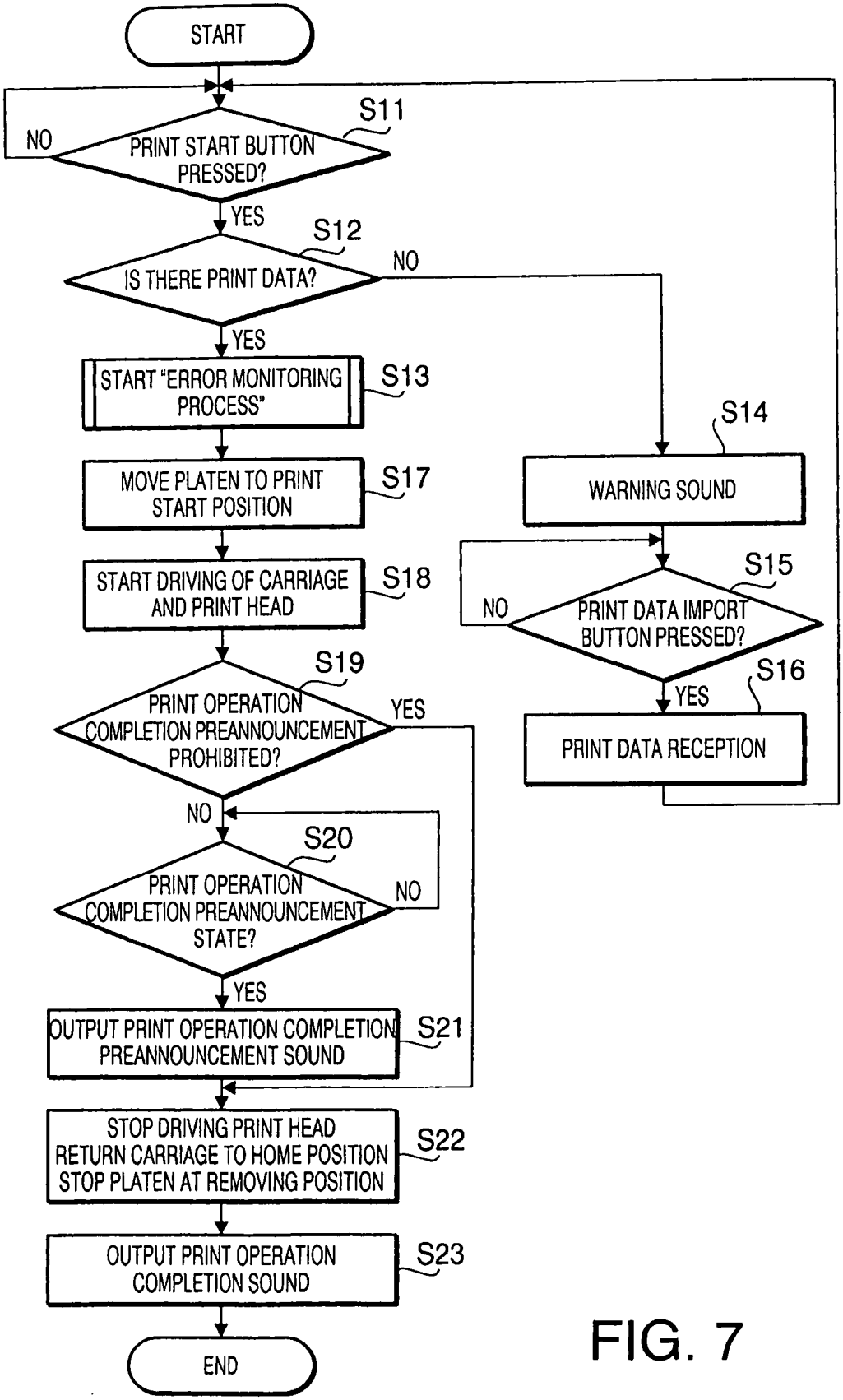
FIG. 7 is a flow chart of a printing process which is executed by each of first and second printing units of the inkjet printer.
Figure 8:
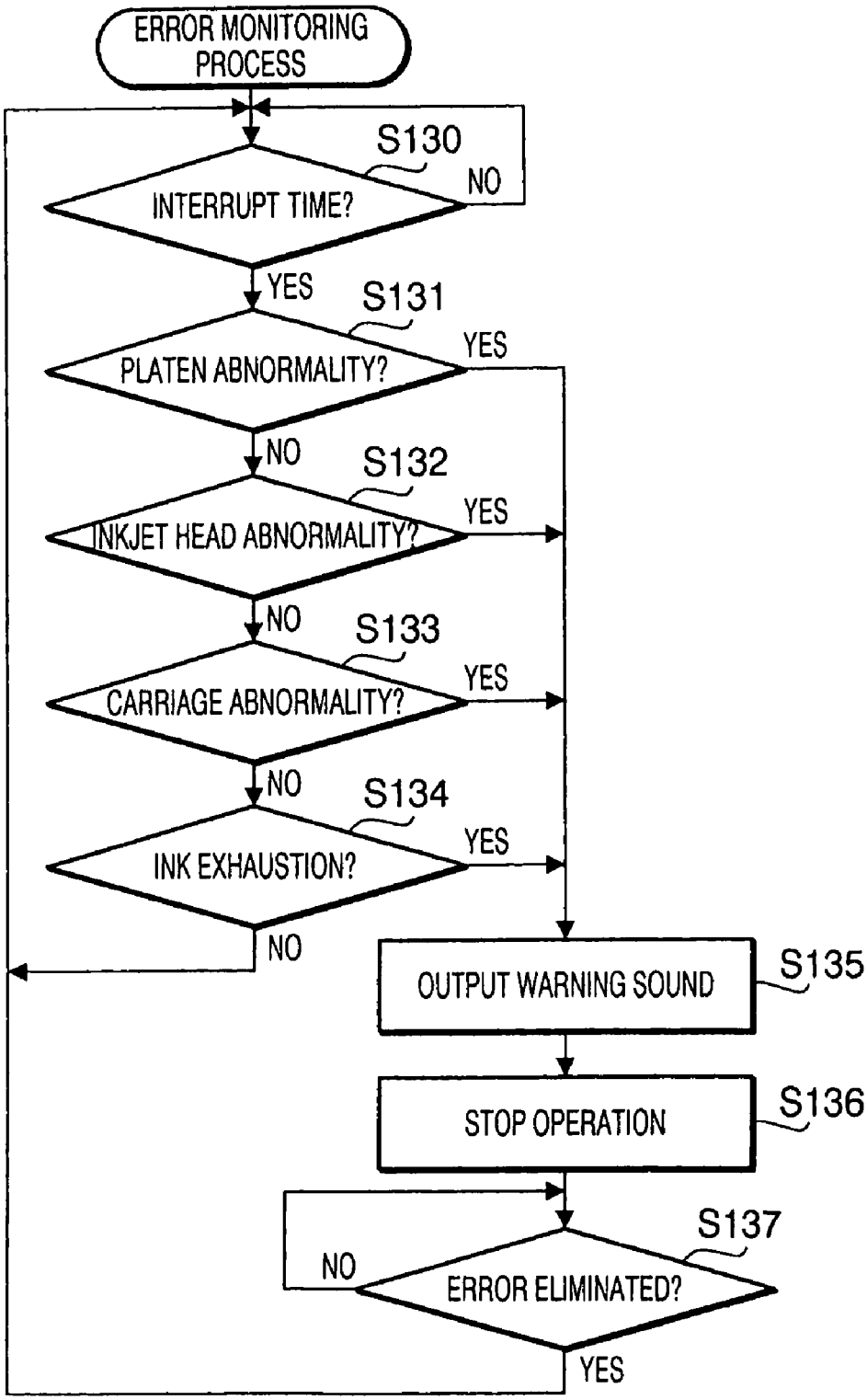
FIG. 8 is a flow chart of an error monitoring process as a subroutine of the printing process of FIG. 7.

In the following, a printing process which is executed by the inkjet printer 1 of this embodiment will be described referring to flow charts of FIGS. 7 and 8. FIG. 7 is a flow chart of the printing process which is executed by each of the first and second printing units. FIG. 8 is a flow chart of an error monitoring process as a subroutine of the printing process of FIG. 7. Control programs for these processes have been prestored in the ROM 102 (as an example of a computer-readable recording medium) of the main control circuit 100. When the printing on a fabric as a print medium (e.g. T-shirt) is carried out by one of the first and second printing units, the fabric (print medium) is held on the first platen 5 or the second platen 6 (serving as a medium holding unit). A case where the printing is executed for a print medium held on the first platen 5 of the first printing unit will be explained below.

First, the print medium is held on the first platen 5. When the first print start button 281 is pressed (S11: YES), whether print data to be printed by the first print head 23 exists in the first print data storage area 1031 of the RAM 103 of the main control circuit 100 or not is judged (S12). If the print data exists in the first print data storage area 1031 (S12: YES), the error monitoring process is started (S13).

Here, the error monitoring process (S13) will be explained referring to the subroutine flow chart of FIG. 8. At each interrupt time which comes at preset intervals (S130: YES), judgments are made on whether abnormality has occurred to the platen (S131), whether abnormality has occurred to the inkjet head (S132), whether abnormality has occurred to the carriage (S133), and whether ink exhaustion (i.e. an ink cartridge out of ink) has occurred (S134). If any of the abnormalities has occurred (S131: YES, S132: YES, S133: YES or S134: YES), a warning sound (e.g. beep) is outputted from the speaker, the error lamp is turned ON (S135), and the operation of the printing unit in which the abnormality has occurred (i.e. the first printing unit or the second printing unit) is stopped (S136). The occurrence of the abnormality (error) is reported to the CPU 101 of the main control circuit 100 by a signal which is transmitted from the control circuit of the erroneous printing unit (i.e. the first printing unit control circuit 120 or the second printing unit control circuit 140). The CPU 101 of the main control circuit 100 stops the operation of the erroneous printing unit only, while letting the other printing unit continue its operation. When the error due to the abnormality has been eliminated (S137: YES), the process returns to the step S130.

Referring again to FIG. 7, since the above error monitoring process (S13) is an interrupt process, the first platen 5 is moved to a print start position (by the driving control of the first platen feed motor 71 by the first platen motor driving circuit 123 of the first printing unit control circuit 120) (S17) immediately after the start of the error monitoring process (S13) and independently of the error monitoring process (S13). Subsequently, the driving of the first carriage 26 is started by the driving control of the first carriage motor 25 by the first carriage motor driving circuit 122 of the first printing unit control circuit 120 (S18). Meanwhile, the driving of the first print head 23 is also started under the control of the first print head driving circuit 121 of the first printing unit control circuit 120 (S18).

Subsequently, whether the print operation completion preannouncement has been prohibited or not is judged (S19). Specifically, the user can make a print operation completion preannouncement prohibition setting (a setting for prohibiting the print operation completion preannouncement) by pressing the warning OFF button 288, for example, and the print operation completion preannouncement prohibition setting is stored in the first flag storage area 1033 of the RAM 103 as the aforementioned print operation completion preannouncement prohibition flag. In such cases, the warning OFF lamp 289 is turned ON to indicate that the print operation completion preannouncement prohibition setting has been made. When the print operation completion preannouncement prohibition flag has not been stored in the first flag storage area 1033 (S19: NO), whether the first printing unit is in a print operation completion preannouncement state or not is judged (S20). For example, the first printing unit is judged to be in the print operation completion preannouncement state (S20: YES) when the movement of the first carriage 26 is within the last five lines, that is, when the number of remaining lines to be covered by the movement of the first carriage 26 relative to the print medium is five or less. On the other hand, when the first carriage 26 has still to move for more than five lines, the first printing unit is judged not to be in the print operation completion preannouncement state (S20: NO) and the process waits until the first carriage 26 reaches the last five-line range.

When the first printing unit is judged to be in the print operation completion preannouncement state (S20: YES), a print operation completion preannouncement sound is outputted from the speaker 285 under the control of the notification control circuit 125 (S21) so as to previously announce that the print operation is going to stop (finish) soon. Subsequently, the driving of the first print head 23 is stopped under the control of the first print head driving circuit 121 of the first printing unit control circuit 120 (S22). Meanwhile, the first carriage 26 is returned to a home position by the driving control of the first carriage motor 25 by the first carriage motor driving circuit 122 of the first printing unit control circuit 120 (S22). Further, the first platen 5 is stopped at a "removing position" (with the first platen 5 protruding from the body cover 10 as shown in FIG. 1) by the first platen feed motor 71 controlled by the first platen motor driving circuit 123 of the first printing unit control circuit 120 (S22).

Finally, a print operation completion sound is outputted from the speaker 285 under the control of the notification control circuit 125 to announce that the print operation (of the first printing unit) is completed (S23).

Incidentally, when no print data has been stored in the first print data storage area 1031 of the RAM 103 in the judgment of S12 (S12: NO), a warning sound is outputted from the speaker 285 under the control of the notification control circuit 125 (S14) to notify the user that no print data has been received. Thereafter, when the first print data import button 282 is pressed by the user (S15: YES), print data is received (imported) from the personal computer 90 via the communication processing unit 107 and stored in the first print data storage area 1031 of the RAM 103 of the main control circuit 100 (S16). At the same time, the data lamp 286 is turned ON to indicate that the print data exists. Thereafter, the process returns to the judgment step S11 and waits until the first print start button 281 is pressed by the user (S11: NO). When the first print start button 281 is pressed (S11: YES), the process advances to the aforementioned steps S12-S23.

Next, another case where the printing is executed for a print medium held on the second platen 6 of the second printing unit will be explained below referring to the flow charts of FIGS. 7 and 8.

First, the print medium is held on the second platen 6. When the second print start button 271 is pressed (S11: YES), whether print data to be printed by the second print head 21 exists in the second print data storage area 1032 of the RAM 103 of the main control circuit 100 or not is judged (S12). If the print data exists in the second print data storage area 1032 (S12: YES), the error monitoring process is started (S13) similarly to the above example. Subsequently, the second platen 6 is moved to a print start position (for the second platen 6) by the driving control of the second platen feed motor 81 by the second platen motor driving circuit 143 of the second printing unit control circuit 140 (S17). Subsequently, the driving of the second carriage 22 is started by the driving control of the second carriage motor 24 by the second carriage motor driving circuit 142 of the second printing unit control circuit 140 (S18). Meanwhile, the driving of the second print head 21 is also started under the control of the second print head driving circuit 141 of the second printing unit control circuit 140 (S18).

Subsequently, whether the print operation completion preannouncement has been prohibited or not is judged (S19). Specifically, the user can make the print operation completion preannouncement prohibition setting (regarding the second printing unit) by pressing the warning OFF button 288, for example, and the print operation completion preannouncement prohibition setting is stored in the second flag storage area 1034 of the RAM 103 as the aforementioned print operation completion preannouncement prohibition flag. In such cases, the warning OFF lamp 279 is turned ON to indicate that the print operation completion preannouncement prohibition setting has been made. When the print operation completion preannouncement prohibition flag has not been stored in the second flag storage area 1034 (S19: NO), whether the second printing unit is in the print operation completion preannouncement state or not is judged (S20). For example, the second printing unit is judged to be in the print operation completion preannouncement state (S20: YES) when the movement of the second carriage 22 is within the last five lines, that is, when the number of remaining lines to be covered by the movement of the second carriage 22 relative to the print medium is five or less. On the other hand, when the second carriage 22 has still to move for more than five lines, the second printing unit is judged not to be in the print operation completion preannouncement state (S20: NO) and the process waits until the second carriage 22 comes within the last five-line range.

When the second printing unit is judged to be in the print operation completion preannouncement state (S20: YES), the print operation completion preannouncement sound is outputted from the speaker 275 under the control of the notification control circuit 145 (S21) so as to previously announce that the print operation is going to stop (finish) soon. Subsequently, the driving of the second print head 21 is stopped under the control of the second print head driving circuit 141 of the second printing unit control circuit 140 (S22). Meanwhile, the second carriage 22 is returned to its home position by the driving control of the second carriage motor 24 by the second carriage motor driving circuit 142 of the second printing unit control circuit 140 (S22). Further, the second platen 6 is stopped at its "removing position" (with the second platen 6 protruding from the body cover 10 as shown in FIG. 1) by the second platen feed motor 81 controlled by the second platen motor driving circuit 143 of the second printing unit control circuit 140 (S22).

Finally, the print operation completion sound is outputted from the speaker 275 under the control of the notification control circuit 145 to announce that the print operation is completed (S23).

Incidentally, when no print data has been stored in the second print data storage area 1032 of the RAM 103 in the judgment of S12 (S12: NO), the warning sound is outputted from the speaker 275 under the control of the notification control circuit 145 (S14) to notify the user that no print data has been received. Thereafter, when the second print data import button 272 is pressed by the user (S15: YES), print data is received (imported) from the personal computer 90 via the communication processing unit 107 and stored in the second print data storage area 1032 of the RAM 103 of the main control circuit 100 (S16). At the same time, the data lamp 276 is turned ON to indicate that the print data exists. Thereafter, the process returns to the judgment step S11 and waits until the second print start button 271 is pressed by the user (S11: NO). When the second print start button 271 is pressed (S11: YES), the process advances to the aforementioned steps S12-S23.

Figure 9:
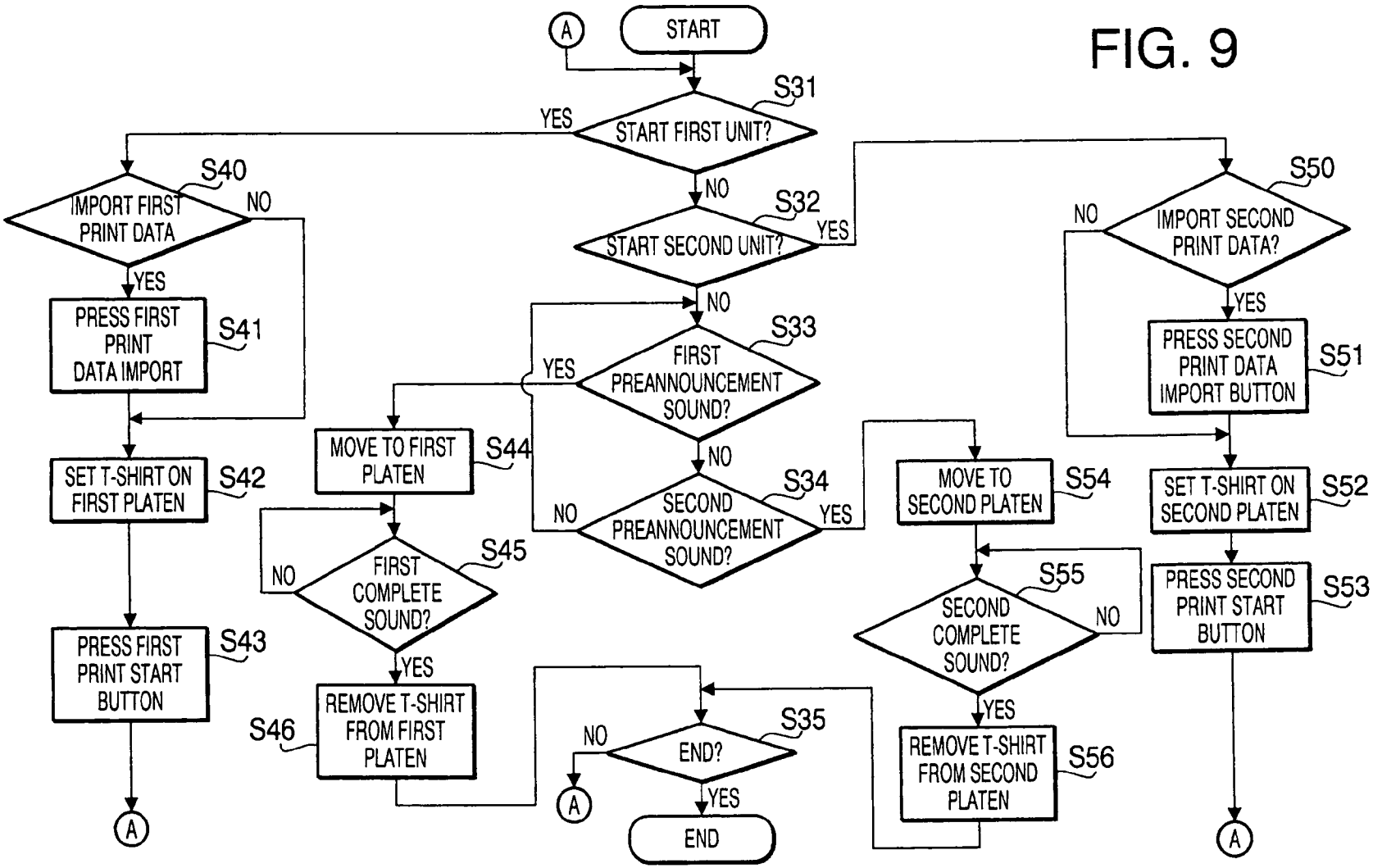
FIG. 9 is a flow chart showing the flow of work carried out by the user (operator) of the inkjet printer.

In the following, the flow of work carried out by the user (operator) of the inkjet printer 1 will be described referring to a flow chart of FIG. 9. When the user starts the printing by use of the first printing unit (S31: YES), the process of FIG. 9 advances to step S40, otherwise (S31: NO) the process advances to step S32. In the step S40, when the print data for the first print head 23 (first print data) has to be imported (when no first print data has been stored in the first print data storage area 1031 or when first print data already stored in the first print data storage area 1031 has to be changed to new data) (S40: YES), the user presses the first print data import button 282 (S41), by which the first print data is imported from the personal computer 90 and stored in the first print data storage area 1031 of the RAM 103. When the import of the first print data is unnecessary (S40: NO), the user does not press the first print data import button 282, that is, the step S41 is skipped. Subsequently, the user sets a T-shirt ("first T-shirt" as a print medium) on the first platen 5 (S42) and presses the first print start button 281(S43), by which the first platen 5 is moved to its print start position and the printing of the first print data on the first T-shirt by the first print head 23 is started. Thereafter, the process returns to the step S31.

Meanwhile, when the user starts the printing by use of the second printing unit (S32: YES), the process advances to step S50, otherwise (S32: NO) the process advances to step S33. In the step S50, when the print data for the second print head 21 (second print data) has to be imported (when no second print data has been stored in the second print data storage area 1032 or when second print data already stored in the second print data storage area 1032 has to be changed to new data) (S50: YES), the user presses the second print data import button 272 (S51), by which the second print data is imported from the personal computer 90 and stored in the second print data storage area 1032 of the RAM 103. When the import of the second print data is unnecessary (S50: NO), the user does not press the second print data import button 272, that is, the step S51 is skipped. Subsequently, the user sets a T-shirt ("second T-shirt" as a print medium) on the second platen 6 (S52) and presses the second print start button 271 (S53), by which the second platen 6 is moved to its print start position and the printing of the second print data on the second T-shirt by the second print head 21 is started. Thereafter, the process returns to the step S31.

As the printing by the first print head 23 proceeds, the number of remaining lines to be covered by the movement of the first carriage 26 (relative to the first T-shirt) in the auxiliary scanning direction (due to the movement of the first platen 5 in the auxiliary scanning direction) decreases. When the number of the remaining lines for the first carriage 26 has become 5 or less, a "first print operation completion preannouncement sound" (for announcing that the print operation on the first T-shirt by the first print head 23 will be completed soon) is outputted from the speaker 285. The user recognizing the first print operation completion preannouncement sound (S33: YES) moves to the front of the first platen 5 (S44) and waits for the completion of the printing. When the printing by the first print head 23 is completed, the first platen 5 moves to the front of the body cover 10 and stops at the removing position as shown in FIG. 1. At this time, a "first print operation completion sound" (for announcing that the print operation on the first T-shirt by the first print head 23 is completed) is outputted from the speaker 285. The user recognizing the first print operation completion sound (S45: YES) removes the first T-shirt from the first platen 5 (S46). Thereafter, the process ends when the user hopes to end the printing by the inkjet printer 1 (S35: YES), otherwise (S35: NO) the process returns to the step S31.

Meanwhile, as the printing by the second print head 21 proceeds, the number of remaining lines to be covered by the movement of the second carriage 22 (relative to the second T-shirt) in the auxiliary scanning direction (due to the movement of the second platen 6 in the auxiliary scanning direction) decreases. When the number of the remaining lines for the second carriage 22 has become 5 or less, a "second print operation completion preannouncement sound" (for announcing that the print operation on the second T-shirt by the second print head 21 will be completed soon) is outputted from the speaker 275. The user recognizing the second print operation completion preannouncement sound (S34: YES) moves to the front of the second platen 6 (S54) and waits for the completion of the printing. When the printing by the second print head 21 is completed, the second platen 6 moves to the front of the body cover 10 and stops at the removing position as shown in FIG. 1. At this time, a "second print operation completion sound" (for announcing that the print operation on the second T-shirt by the second print head 21 is completed) is outputted from the speaker 275. The user recognizing the second print operation completion sound (S55: YES) removes the second T-shirt from the second platen 6 (S56). Thereafter, the process ends when the user hopes to end the printing by the inkjet printer 1 (S35: YES), otherwise (S35: NO) the process returns to the step S31.

As described above, the inkjet printer 1 in accordance with the first embodiment of the present invention is equipped with the first printing unit including the first print head 23, the first carriage 26, the first platen 5, the first printing unit control circuit 120, etc. and the second printing unit including the second print head 21, the second carriage 22, the second platen 6, the second printing unit control circuit 140, etc. The first printing unit and the second printing unit are capable of executing printing independently of each other. Therefore, printing of different print data by the first and second printing units, independent replacement of the first and second platens 5 and 6 (even replacement with platens of sizes different from each other), etc. are possible.

Further, in the inkjet printer 1 of the first embodiment, even in the event of an error (e.g. ink exhaustion) occurring in the first printing unit or the second printing unit, the print operation is stopped only in the printing unit to which the error has occurred, letting the other printing unit continue its print operation.

The first and second print operation completion preannouncement sounds are preannouncement sounds different (distinguishable) from each other. The first and second print operation completion sounds are sounds different (distinguishable) from the preannouncement sounds and different (distinguishable) from each other. Therefore, the user (operator) hearing one of the sounds can correctly obtain information on the print operation of the printing unit corresponding to the sound, even when the user is handling the other printing unit or doing a different task. Thus, after the pressing of the first print start button 281 and/or the second print start button 271, the user can easily and correctly grasp the proceedings (progress status) of the printing by the first printing unit and/or the second printing unit, without the need of viewing the first operation panel 28 or the second operation panel 27.

In order to make the sounds (first print operation completion preannouncement sound, second print operation completion preannouncement sound, first print operation completion sound, second print operation completion sound) distinguishable from one another, the sounds may be prepared to differ in one or more selected from frequency, length, melody, etc. The output of the first and second print operation completion preannouncement sounds from the speakers 285 and 275 can be prohibited by the user, by pressing the warning OFF buttons 288 and 278. The warning OFF buttons 288 and 278 (used for prohibiting the output of the first and second print operation completion preannouncement sounds in this embodiment) may also be used for prohibiting the output of all warning sounds including the first and second print operation completion preannouncement sounds and the first and second print operation completion sounds. Further, the output of the first and second print operation completion preannouncement sounds and the first and second print operation completion sounds from the speakers may be replaced with appropriate display by use of light-emitting units such as lamps (e.g. LEDs).

In the inkjet printer 1 of the first embodiment, the first ink cartridge storing unit 32 is placed on a lateral face of the body cover 10 on the same side (right-hand side) as the first platen 5 and the first operation panel 28 (having the error lamp 287 indicating ink exhaustion), while the second ink cartridge storing unit 31 is placed on a lateral face of the body cover 10 on the same side (left-hand side) as the second platen 6 and the second operation panel 27 (having the error lamp 277 indicating ink exhaustion). Thus, the user noticing the lighting of the error lamp 287 or 277 can intuitively recognize which of the ink cartridge storing units 32 and 31 needs ink cartridge replacement.

The improvement of workability and efficiency of the inkjet printer 1 of this embodiment is highly dependent on whether the first and second print heads 23 and 21 can be kept in operation with minimum interruptions. In the inkjet printer 1, each of the first and second printing units (equipped with the notification control circuits 125 and 145, respectively) is capable of accurately notifying the user (operator) that its print operation is completed or is going to be completed soon. Thus, the user is allowed to make preparations for the next printing (the transmission (import) of print data to the inkjet printer 1, the attachment/detachment of the print medium, etc.) smoothly and without delay, by which the useless "standby time" of the inkjet printer 1 can be reduced to a minimum.

Specifically, the first/second print operation completion preannouncement sound may be outputted from the speaker when the driving of the head (which already finished the printing) is stopped (approximately 5 seconds before the completion of the print operation), when the carriage has reached a position a prescribed number of scans (e.g. 5 scans) before the print operation completion, or when the first/second platen (or a part of the first/second feeding mechanism for feeding the platen and the print medium) has reached a prescribed position (detected by a sensor or a position judgment unit), for example. With the print operation completion preannouncement sound, the user (even when doing a different task) is allowed to advance to the next work smoothly by moving to the front of the platen corresponding to the preannouncement sound (from the front of the other platen, for example) with proper timing, that is, when the user feels that the print operation (or mainly, the printing) is completed. Since the first and second print operation completion preannouncement sounds can be prohibited by the user through the first and second operation panels 28 and 27, respectively, the user (notified of necessary information only) is allowed to perform his/her work smoothly, without being alarmed and disturbed uselessly.

Embodiment 2

Figure 10:
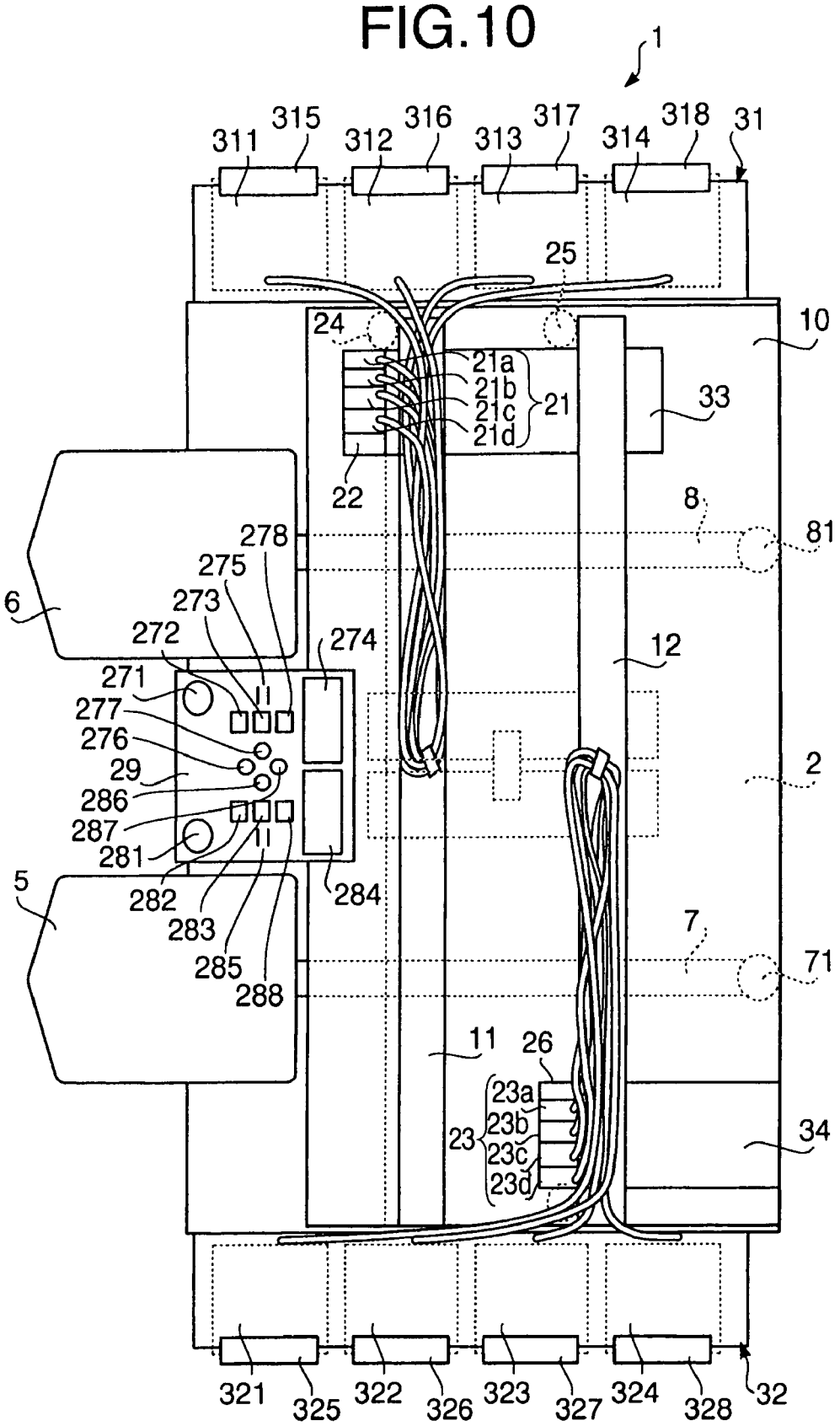
FIG. 10 is a plan view of an inkjet printer (printing device) in accordance with a second embodiment of the present invention.

FIG. 10 is a plan view of an inkjet printer 1 (printing device) in accordance with a second embodiment of the present invention. In the inkjet printer 1 shown in FIG. 10, one operation panel 29, integrating the functions of the first and second operation panels 28 and 27 in the first embodiment, is placed at the center of the front of the inkjet printer 1. Also with the inkjet printer 1 of the second embodiment, the effects described in the first embodiment can be achieved.

Incidentally, while the operation panel 29 shown in FIG. 10 includes two speakers 285 and 275 for the first and second printing units, respectively, the operation panel 29 may also be designed to include only one speaker when the sounds (print operation completion preannouncement sound, print operation completion sound, warning sound) regarding the first printing unit and those regarding the second printing unit are distinguishable from each other. While a description has been given above of preferred embodiments in accordance with the present invention, the present invention is not to be restricted by the particular illustrative embodiments and a variety of modifications, design changes, etc. are possible without departing from the scope and spirit of the present invention described in the appended claims.

What is claimed is:

1. A printing device comprising:

a first print unit that includes:

a first print head that discharges ink onto a print medium according to print data;

a first print head control unit that controls the discharge of ink from the first print head; and a first print head feeding unit that moves the first print head in a main scanning direction relative to the print medium;

a second print unit that includes:

a second print head that discharges ink onto a print medium according to print data;

a second print head control unit that controls the discharge of ink from the second print head; and a second print head feeding unit that moves the second print head in the main scanning direction relative to the print medium;

a first medium holding unit having a holding surface for holding one print medium;

a second medium holding unit having a holding surface for holding one print medium;

a first medium feeding unit capable of moving the first medium holding unit to and from in an auxiliary scanning direction orthogonal to the main scanning direction;

a second medium feeding unit capable of moving the second medium holding unit to and from in the auxiliary scanning direction in parallel with the movement of the first medium feeding unit;

a first control unit that controls a printing operation of the first print unit; and a second control unit that controls a printing operation of the second print unit, wherein, when the first control unit controls the first print unit to execute printing and when the second control unit controls the second print unit to executing printing, if an error related to one of the first print head and the first print head feeding unit occurs, the first control unit controls the first print unit to stop printing, while the second control unit controls the second print unit to continue printing, and if an error related to one of the second print head and the second print head feeding unit occurs, the second control unit controls the second print unit to stop printing, while the first control unit controls the first print unit to continue printing.

2. The printing device according to claim 1, further comprising an ink supplying unit that supplies ink to the first print head and the second print head, wherein, when the first control unit controls the first print unit to execute printing and when the second control unit controls the second print unit to execute printing, if an error related to ink supply from the ink supplying unit to the first print head occurs, the first control unit controls the first print unit to stop printing, while the second control unit controls the second print unit to continue printing, and if an error related to ink supply from the ink supplying unit to the second print head occurs, the second control unit controls the second print unit to stop printing, while the first control unit controls the first print unit to continue printing.

3. The printing device according to claim 1, further comprising:

a first notification unit that gives at least one selected from notification of operation completion, previous notification of operation completion and notification of occurrence of error during the control of the first print head control unit, the first print head feeding unit and the first medium feeding unit by the first control unit; and a second notification unit that gives at least one selected from notification of operation completion, previous notification of operation completion and notification of occurrence of error during the control of the second print head control unit, the second print head feeding unit and the second medium feeding unit by the second control unit.

4. The printing device according to claim 3, further comprising a casing, the first notification unit being provided at one end, in the main scanning direction, of the casing and the second notification unit being provided at the other end, in the main scanning direction, of the casing, wherein an ink supplying unit includes a first ink supplying unit and a second ink supplying unit that supply ink to the first print head and the second print head, respectively, and wherein the first ink supplying unit is provided on the one end side of the casing and the second ink supplying unit is provided on the other end side of the casing.

5. The printing device according to claim 4, further comprising a control unit for controlling the first control unit and the second control unit, wherein the control unit controls only the first control unit to stop controlling if the first notification unit notifies occurrence of an error during the control of the first control unit, and wherein the control unit controls only the second control unit to stop controlling if the second notification unit notifies occurrence of an error during the control of the second control unit.

6. The printing device according to claim 4, wherein:

the first and second notification units include at least one speaker, and sounds made by the speaker functioning as the first notification unit for the notification of operation completion, the previous notification of operation completion and/or the notification of occurrence of error and sounds made by the speaker functioning as the second notification unit for the notification of operation completion, the previous notification of operation completion and/or the notification of occurrence of error are distinguishable from each other.

7. The printing device according to claim 4, wherein the first and second notification units include at least one light-emitting unit.

8. A control method of controlling a printing device comprising:

a first print unit that includes:

a first print head that discharges ink onto a print medium according to print data;

a first print head control unit that controls the discharge of ink from the first print head; and a first print head feeding unit that moves the first print head in a main scanning direction relative to the print medium;

a second print unit that includes:

a second print head that discharges ink onto a print medium according to print data;

a second print head control unit that controls the discharge of ink from the second print head; and a second print head feeding unit that moves the second print head in the main scanning direction relative to the print medium;

a first medium holding unit having a holding surface for holding one print medium;

a second medium holding unit having a holding surface for holding one print medium;

a first medium feeding unit capable of moving the first medium holding unit to and from in an auxiliary scanning direction orthogonal to the main scanning direction;

a second medium feeding unit capable of moving the second medium holding unit to and from in the auxiliary scanning direction in parallel with the movement of the first medium feeding unit;

a first control unit that controls a printing operation of the first print unit; and a second control unit that controls a printing operation of the second print unit, wherein, the first control unit controls the first print unit to execute printing and the second control unit controls the second print unit to execute printing, the method comprising:

controlling the first print unit via the first control unit to stop printing, while controlling the second print unit via the second control unit to continue printing, if an error related to one of the first print head and the first print head feeding unit occurs, and controlling the second print unit via the second control unit to stop printing, while controlling the first print unit via the first control unit to continue printing, if an error related to one of the second print head and the second print head feeding unit occurs.

9. The control method according to claim 8, wherein said printing device further comprising an ink supplying unit that supplies ink to the first print head and the second print head, and wherein, when the first control unit controls the first print unit to execute printing and when the second control unit controls the second print unit to execute printing, if an error related to ink supply from the ink supplying unit to the first print head occurs, the first control unit performs a step of controlling the first print unit to stop printing, while the second control unit performs a step of controlling the second print unit to continue printing, and if an error related to ink supply from the ink supplying unit to the second print head occurs, the second control unit performs a step of controlling the second print unit to stop printing, while the first control unit performs a step of controlling the first print unit to continue printing.

10. The control method according to claim 8, comprising:

making a first notification unit give at least one selected from notification of operation completion, previous notification of operation completion and notification of occurrence of error during the control of the first print head control unit, the first print head feeding unit and the first medium feeding unit by the first control unit; and making a second notification unit give at least one selected from notification of operation completion, previous notification of operation completion and notification of occurrence of error during the control of the second print head control unit, the second print head feeding unit and the second medium feeding unit by the second control unit.

11. The control method according to claim 10, wherein said printing device further comprising:

a casing, the first notification unit being provided at one end, in the main scanning direction, of the casing and the second notification unit being provided at the other end, in the main scanning direction, of the casing, and an ink supplying unit that includes a first ink supplying unit and a second ink supplying unit that supply ink to the first print head and the second print head, respectively, and wherein the first ink supplying unit is provided on the one end side of the casing and the second ink supplying unit is provided on the other end side of the casing.

12. The control method according to claim 11, wherein said printing device further comprising a control unit for controlling the first control unit and the second control unit, wherein the control unit performs a step of controlling only the first control unit to stop controlling if the first notification unit notifies occurrence of an error during the control of the first control unit, and wherein the control unit performs a step of controlling only the second control unit to stop controlling if the second notification unit notifies occurrence of an error during the control of the second control unit.

13. The control method according to claim 11, wherein the first and second notification units include at least one speaker, and wherein sounds made in the first notification step by the speaker functioning as the first notification unit for the notification of operation completion, the previous notification of operation completion and/or the notification of occurrence of error and sounds made in the second notification step by the speaker functioning as the second notification unit for the notification of operation completion, the previous notification of operation completion and/or the notification of occurrence of error are distinguishable from each other.

14. The control method according to claim 11, wherein the first and second notification units include at least one light-emitting unit.

15. A non-transitory computer-readable recording medium storing computer-readable instructions that cause a computer to execute the control method according to claim 8.

* * * * *